United States Patent [19]

Klaus

[11] 4,319,795

[45] Mar. 16, 1982

[54] FLAT FILE

[75] Inventor: Gerald R. Klaus, St. Charles, Ill.

[73] Assignee: Fellowes Manufacturing Company, Itasca, Ill.

[21] Appl. No.: 98,639

[22] Filed: Nov. 29, 1979

[51] Int. Cl.[3] ..... A47B 88/00; B65D 6/00; B65D 57/00

[52] U.S. Cl. ..... 312/330 R; 312/111; 312/259; 312/261; 220/4 F; 220/22.3; 211/40

[58] Field of Search ..... 312/330 R, 107, 108, 312/111, 259, 261; 220/4 R, 4 F, DIG. 25, 22.2, 22.3; 248/345.1

[56] References Cited

U.S. PATENT DOCUMENTS

| | | | |
|---|---|---|---|
| 1,523,136 | 1/1925 | O'Connor | 211/40 |
| 1,654,225 | 12/1927 | Tanner | 220/DIG. 25 |
| 1,939,651 | 12/1933 | Bales | 220/22.3 |
| 2,171,105 | 8/1939 | Wurzburg | 312/261 |
| 2,176,284 | 10/1939 | Whiteford | 220/22.3 |
| 2,372,805 | 4/1945 | Balkind | 312/259 |
| 2,446,896 | 8/1948 | Wellman | 312/330 |
| 2,547,463 | 4/1951 | Haut | 312/107 |
| 2,704,699 | 3/1955 | Evans | 312/330 |
| 2,904,382 | 9/1959 | Mitten | 312/259 |
| 3,024,939 | 3/1962 | Kantor | 220/4 R |
| 3,358,725 | 12/1967 | Bussard et al. | 248/345.1 |
| 3,446,345 | 5/1969 | Frosoy | 248/345.1 |
| 3,494,685 | 2/1970 | Fiterman et al. | 312/261 |
| 3,550,978 | 12/1970 | Magee | 312/108 |
| 3,613,931 | 10/1971 | Schifferle | 312/111 |

FOREIGN PATENT DOCUMENTS

| | | | |
|---|---|---|---|
| 1160414 | 8/1969 | United Kingdom | 312/330 R |

OTHER PUBLICATIONS

Colight Model 500, two page Brochure, and Colight Models 200, 300, 400 & 600, one page Brochure, Jan. 8, 1964.

*Primary Examiner*—Victor N. Sakran
*Attorney, Agent, or Firm*—Hume, Clement, Brinks, Willian & Olds, Ltd.

[57] ABSTRACT

A storage unit is provided, which is particularly adapted for use as a flat file, comprising a fiberboard housing having a plurality of particle board shelf-supporting panels with recesses that support fiberboard drawer shelves encased at their forward edges by a rigid casing, and further including a rigid peripheral frame for the open end of the housing, and a plurality of drawers preferably having large horizontal dimensions relative their respective heights.

9 Claims, 9 Drawing Figures

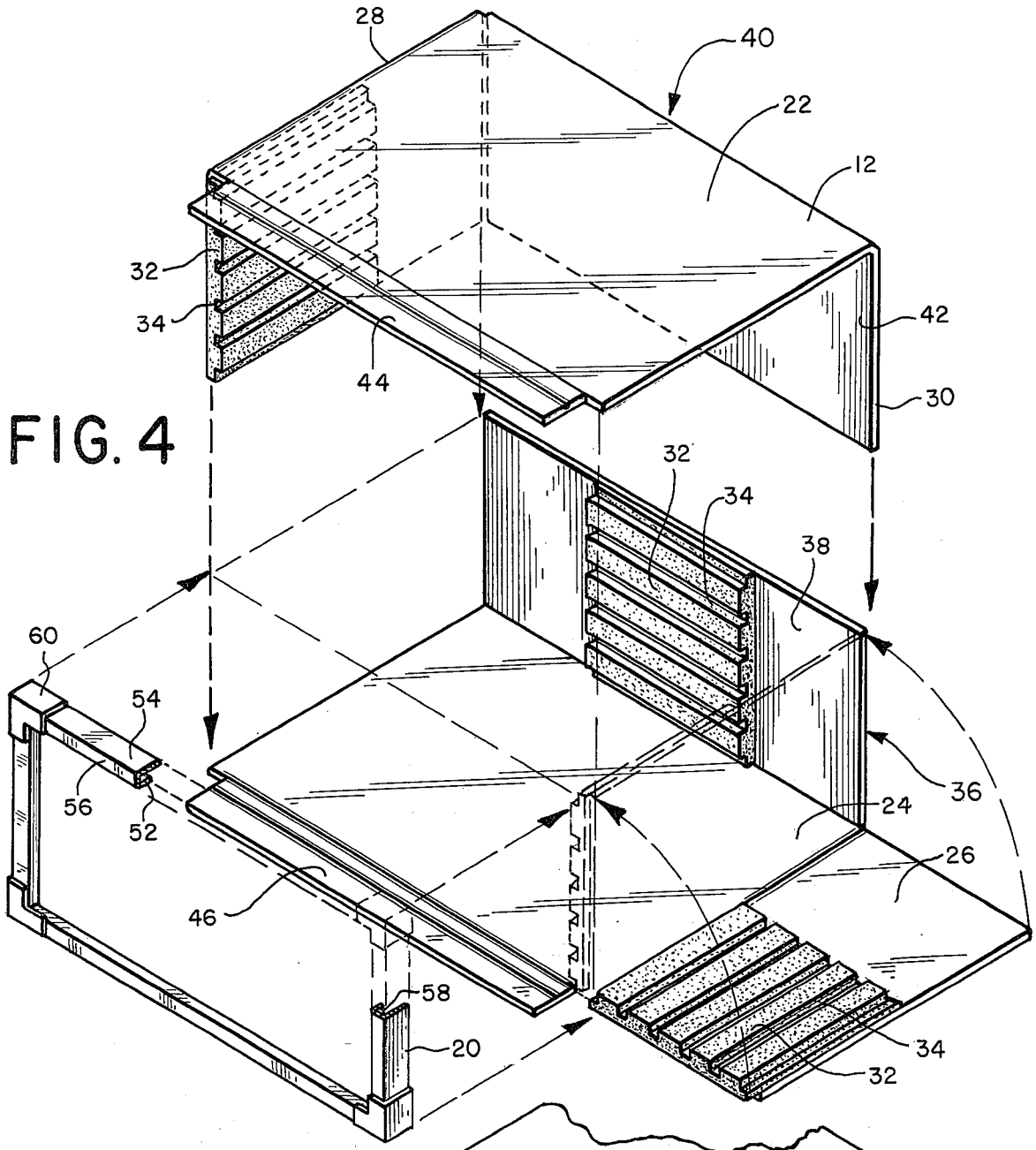
FIG. 4
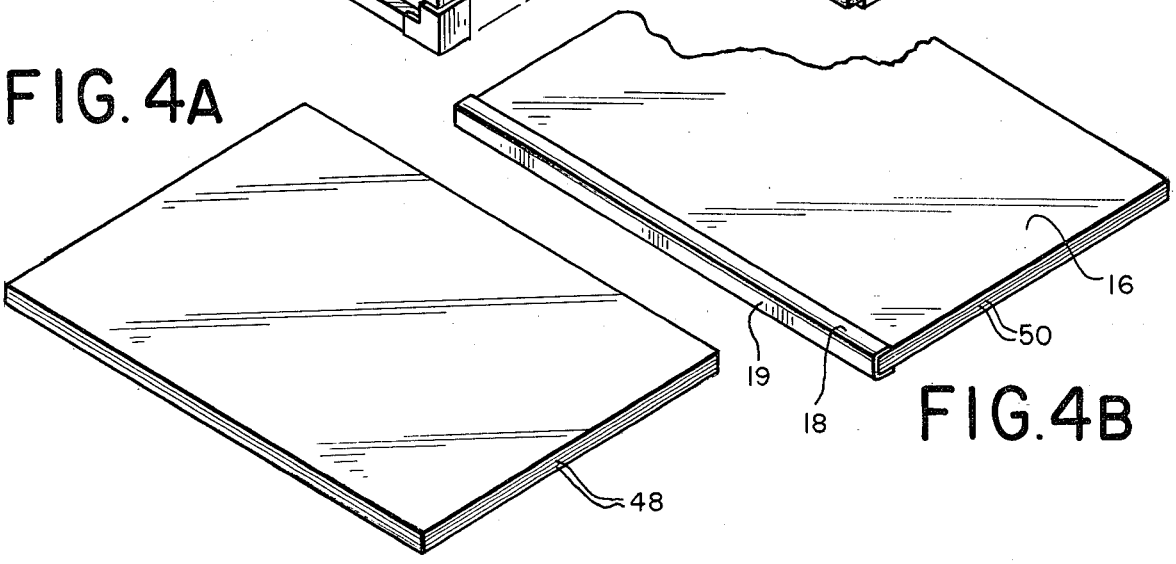
FIG. 4A
FIG. 4B

FIG. 5
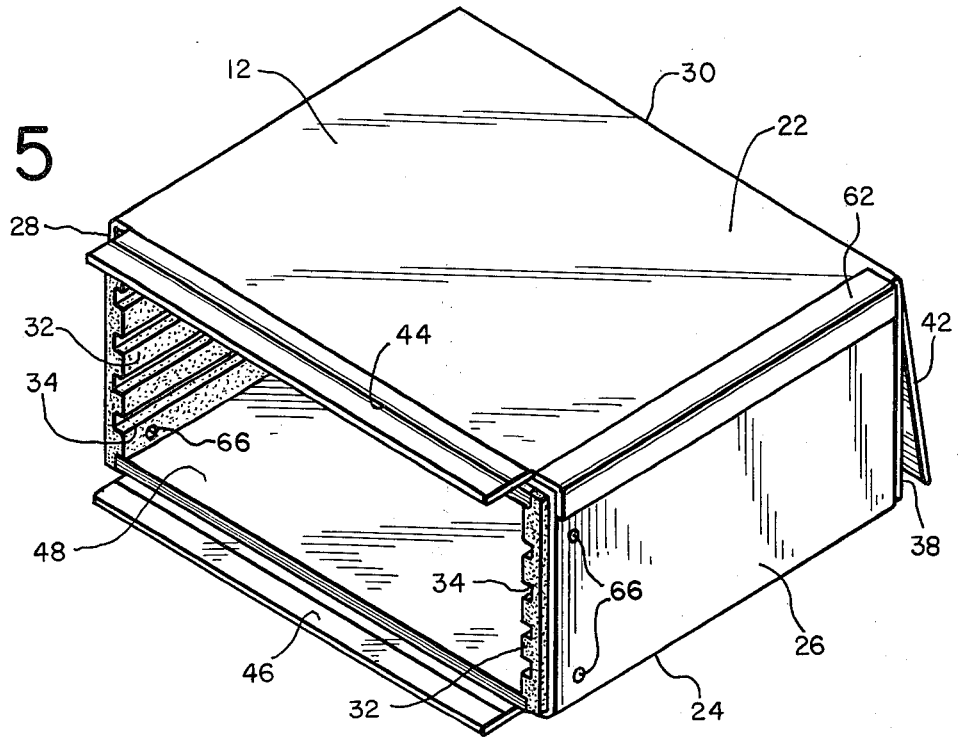
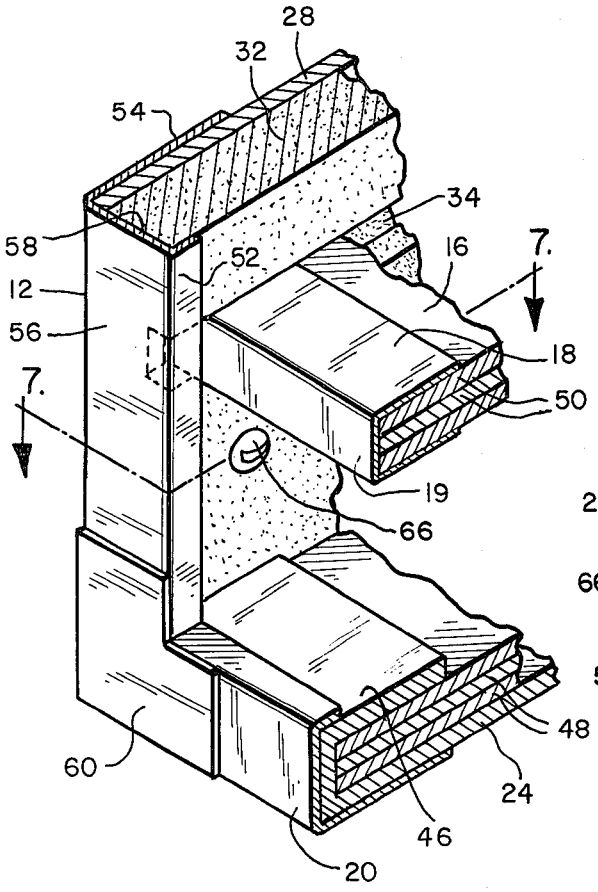
FIG. 6
FIG. 7
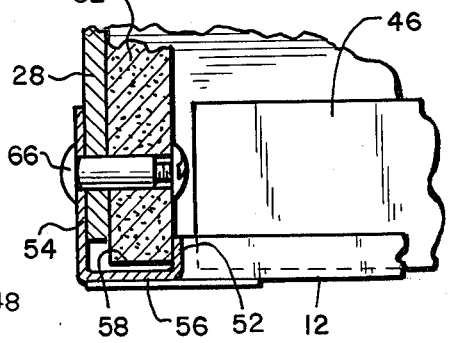

FLAT FILE

TECHNICAL FIELD

The present invention is an improvement in the field of fiberboard storage units, particularly those storage units referred to as flat files. Flat files are storage units with a plurality of drawers designed to hold large documents, such as blue prints, art layouts, and the like, particularly to hold such documents while they are laid out flat. For such purposes, the drawers must be unusually broad and deep, and generally have little height.

BACKGROUND OF THE INVENTION

Fiberboard storage units generally have gained wide acceptance for office use. They are less expensive than units made of wood or metal. They also are relatively light in weight and often are at least partially collapsible, making the units easy to store when not in use or when not yet completely assembled.

Although many fiberboard storage units visually resemble their wood and metal counterparts, their design drastically differs. They usually cannot be assembled with any significant amount of conventional nuts and bolts because the weight of conventional hardware, and the perforations necessary to use such hardware, are detrimental to the strength of these units. Fiberboard units instead are assembled from blanks that are scored and folded, and taped, and the use of screws and bolts is generally avoided. Often panels are folded upon themselves to present an attractive edge and obtain at least a double layer for strength.

Achieving the strength and durability necessary for the end use is a particularly critical problem in the construction of flat files. Their drawers have extreme breadth (the horizontal dimension from side to side) and depth (the horizontal dimension from front to back) and yet the drawers cannot generally be of any great height, it being desirable to store large documents in a plurality of shallow drawers. It is also desirable, however, to form both the drawers and the drawer dividers, or shelves, out of fiberboard. The dimensional requirements of flat files severely tax the natural strength of fiberboard and conventional fiberboard designs.

Adding strength to fiberboard flat files has been a goal long sought after in the field. It has been known in the art to use a reinforcing bar sandwiched between layers of the fiberboard drawer dividers. That this innovation alone was not sufficient is seen by the disclosures of U.S. Pat. No. 3,494,685 that include, in addition to an optional reinforcing bar, an external channelled frame comprising a perimeter frame for the shell, or housing, that engages and supports cross braces for the drawer dividers.

It is desirable, however, to increase the strength of flat files beyond that of these prior art designs without departing significantly from the low cost and convenience of fiberboard construction. It is also desirable to provide both a peripheral frame for the unit's shell and cross frames for the shelves, which frames are not interconnected so that removal of the peripheral frame does not overly diminish the support being given to the shelves that bear the weight of the documents stored in the drawers.

DISCLOSURE OF THE INVENTION

The present invention provides a storage unit of significant fiberboard construction, suitable in dimensions for flat file use and having surprising strength, that includes separate channelled frames for the drawer shelves and shell, or housing, and further includes drawer-shelf supports, i.e., reinforcing panels, formed of particle board. This storage unit, of course, can be used for storage of objects other than documents that must be stored flat, but for convenience, the unit will be referred to hereinafter as a flat file.

The flat file includes a shell having five fiberboard walls, i.e., a top, a bottom, a rear, and two side walls. The side walls and rear wall include particle board reinforcing panels. These panels have recesses that receive and support the drawer shelves at their sides and rear. As will be described further below, these reinforcing panels need not be coextensive with their respective fiberboard walls.

The channelled frames on the front edges of the drawer shelves are supported by the reinforcing panels of the side walls. The peripheral frame is formed as a continuous channel that receives the forward edges of the top and bottom walls and the forward edges of the side walls together with their respective reinforcing panels. The front faces of the shelf frames are therefore disposed behind the inward legs of the channelled peripheral frame wherever they coincide.

BRIEF DESCRIPTION OF THE DRAWINGS

FIG. 4 is an exploded perspective view of the flat file of FIG. 1, shown without the drawers;

FIG. 4A is a perspective view of a wall reinforcing layer of the flat file of FIG. 4;

FIG. 4B is a perspective view of a shelf of the flat file of FIG. 4, shown with a shelf frame;

FIG. 5 is a perspective view of the shell of the flat file of FIG. 1, shown in partially dismantled form;

FIG. 6 is a fragmentary enlarged view of the lower left corner of the flat file of FIG. 1; and FIG. 7 is a cross-sectional view of the flat file of FIG. 6, taken along line 7—7 of FIG. 6.

PREFERRED EMBODIMENTS OF THE INVENTION

Figure 1:
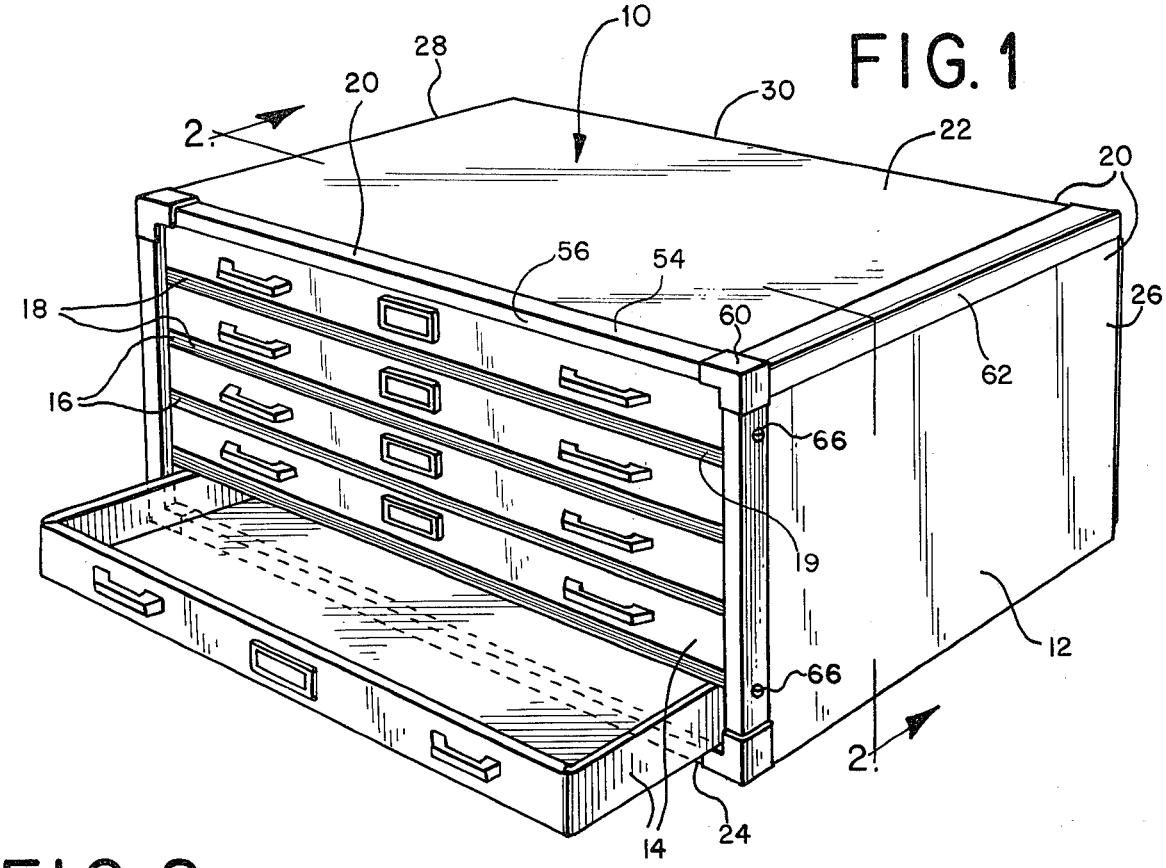
FIG. 1 is a perspective view of a flat file embodying features of the present invention.

Referring first to FIG. 1, there is shown a fiberboard flat file embodying features of the present invention, designated generally by the reference numeral 10. The flat file 10 includes a shell 12 that houses a plurality of drawers 14 slidably supported on drawer shelves 16. The front edges of the shelves 16 are each encased within channelled shelf frame or casing 18 and the front edges of the shell 12 are encased in a channelled peripheral frame 20.

The shell 12 is defined by a plurality of walls that, at least on their exterior sides, are formed of fiberboard. The shell 12, as shown, includes a top wall 22, bottom wall 24, a first and a second side wall 26, 28, and a rear wall 30. The forward edges of the top wall 22, bottom wall 24, and side walls 26, 28 define the open front end of the shell 12. The drawers 14 slide open and closed through this open end of the shell 12.

The flat file 10 is shown with five drawers 14 whose cumulative heights are less than the breadth or depth of any individual drawer 14. Although flat files can be constructed with other numbers of drawers, the five-drawered flat file 10 of relative dimensions similar to that shown in FIG. 1 can be considered preferred both from the desirability of design to the end user and from the strength resultant from the use of the features of the present invention.

Figure 2:
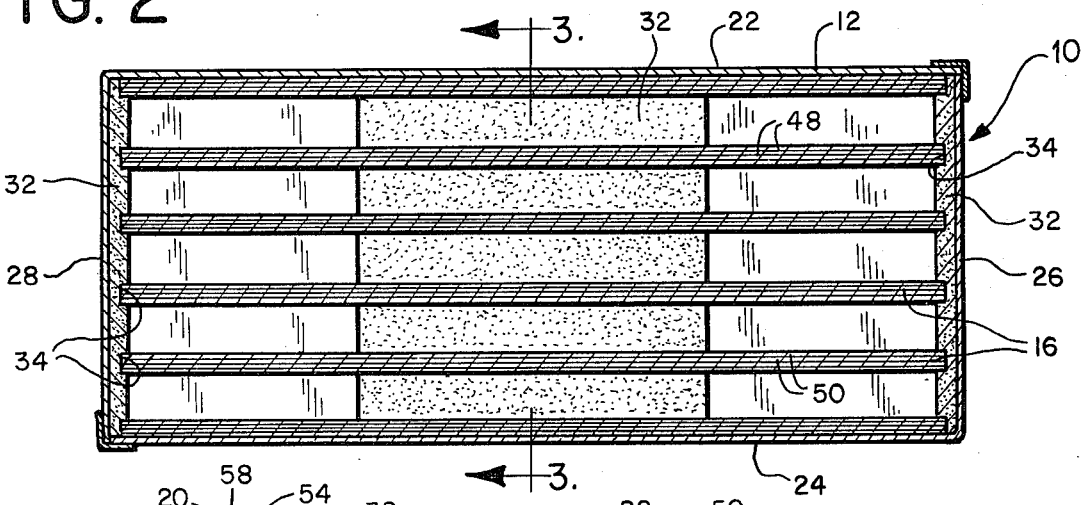
FIG. 2 is a cross-sectional view of the flat file of FIG. 1, shown without the drawers, taken along line 2—2 of FIG. 1.
Figure 3:
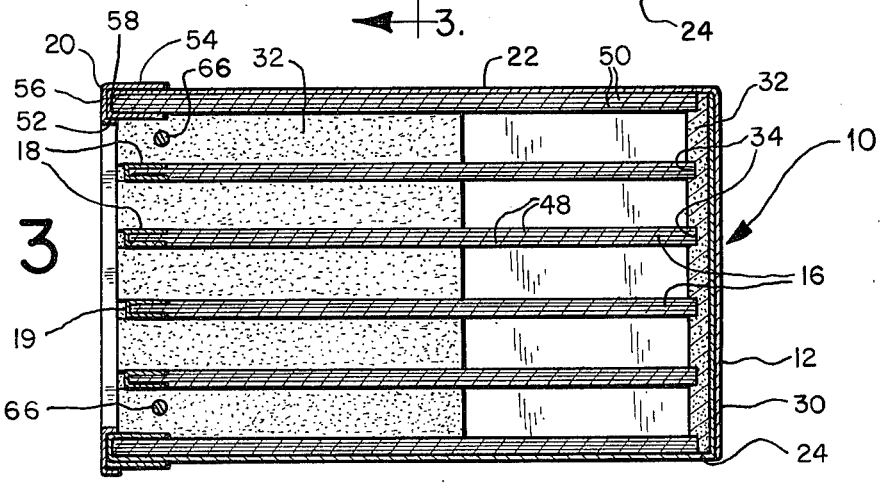
FIG. 3 is a cross-sectional view of the flat file of FIG. 2, taken along line 3—3 of FIG. 2.

Referring now to FIGS. 2 and 3 also, the rear wall 30 and side walls 26, 28 of the shell 12 include, in addition to their external fiberboard construction, drawer-shelf supports or reinforcing panels made of particle board, designated by the reference numeral 32, and referred to hereinafter as the shelf-supporting panels 32. These shelf-supporting panels 32 have horizontal grooves or recesses 34 routed into them that receive the shelves 16 about their side or rear ends. These shelf-supporting panels 32 both support the shelves 16 and retain them from movement upward. The shelf-supporting panels 32 are preferably secured to the fiberboard exterior of their respective walls at least in part by glueing or the like. The shelves 16 may in turn be glued into the recesses 34 of the shelf-supporting panels 32.

The channelled shelf casings 18 preferably are maintained on the forward edges of the shelves 16 by frictional forces only. These shelf casings 18 preferably extend across substantially the entire front of the shelves 16 and are also supported at their opposed longitudinal ends within the recesses 34 of the shelf-supporting panels 32.

The shelf-supporting panels 32 preferably are not coextensive with the fiberboard external portion of their respective walls. It has been found that surprising strength is to be found in flat files 10 where the shelf-supporting panels 32 of the side walls 26, 28 are only coextensive with the fiberboard external construction from their forward edges defining the open end of the shell 12, back about half way or slightly more towards the rear wall 30, in combination with a shelf-supporting panel 32 of the rear wall 30. The shelf-supporting panel 32 of the rear wall 30 is preferably centered on the rear wall 30 but is co-extensive with about from one-third to one-half of the rear wall 30. The optimum strength is believed resultant from this arrangement of shelf-supporting panels 32.

Referring now to FIGS. 4 and 6 also, the shell 12 is seen formed substantially of two fiberboard blanks, a first blank 36 that is scored and folded at the boundaries to define the bottom wall 24, the right side wall 26, and an inner fiberboard layer 38 of the rear wall 30, and a second blank 40 that is scored and folded at boundaries to define the top wall 22, left side wall 28, and an outer fiberboard layer 42 of the rear wall 30. Both the top wall 22 and the bottom wall 24 include forward double-scored flap-extensions, respectively designated 44 and 46. The top wall 22 and bottom wall 24 are preferably reinforced by substantially co-extensive sheets of corrugated fiberboard, generally designated 48 whose forward edges are sandwiched behind the double-scored flap-extensions 44, 46 when folded inwardly and rearwardly. The drawer shelves 16 are also shown comprised of several layers of corrogated sheets of fiberboard, designated 50.

The fiberboard sheets 50 comprising the shelves 16 are each bounded at their forward edges by a channelled shelf casing 18. The open end of the shell 12, including the top and bottom walls 22, 24, plus their respective flap-extensions 44, 46 housing the forward edges of reinforcing fiberboard sheets 48, and the side walls 26, 28, plus their respective shelf-supporting panels 32, are bounded by the peripheral frame 20.

The peripheral frame 20 includes inner and outer spaced-apart legs 52, 54 interconnected by a base forming the frame front 56, together forming a channel 58. The channel 58 receives the open end of the shell 12 bounded by the peripheral frame 20 as described above. Since the shelf-supporting panels 32 adjacent the side walls 26, 28 themselves receive the drawer shelves 16 and their respective shelf casings 18, the inner leg 52 of the peripheral frame 20 extends toward, and is disposed adjacent to, the forward face 19 of the shelf casing 18. The length of this inner leg 52, at least along the sides of the frame 20, is limited by the position of the shelves 16 and casings 18. The shelves 16 and casings 18 are therefore preferably glued or otherwise fixed in place in the recesses 34 of the shelf-supporting panels 32 to prevent accidental movement forward. The outer leg 54 of the frame 20 is not so limited as to length and is preferably longer than the inner leg 52. The individual sides of the frame 20 can be secured together at the corners by conventional joints 60.

The shell 12, when it is formed of the two blanks 36, 40 is preferably taped along the edges where the right side wall 26 meets the top wall 22, and where the left side wall 28 meets the bottom wall 24, and such a taped edge 62 is shown in FIGS. 1 and 5. Referring also to FIGS. 6 and 7, the shelf-supporting panel 32 is preferably bolted to the flat file 10, two bolts to a side. Bolts through the right or left side walls 26,28, designated 66, extend through the outer leg 54 of the frame 20, and the respective side wall 26 or 28, including the shelf-supporting panel 32. Bolts 66 are placed in close proximity to the corners of the flat file 10.

A flat file 10, as described herein and illustrated in the drawings, which measures forty-seven inches across, about twenty-seven inches front to back, and whose five drawers are each about two inches high (and whose layers of corrugated fiberboard contain four sheets each) has dimensional capacity for about 60 lb. of paper, which it holds without any sagging of the drawers. When metal weights were placed into the drawers to test its weight capacity beyond the weight of the typical paper that could be loaded, sagging to the extent of interference with the drawer opening or closing only occurred at about 100 lb. Files having proportionally lesser dimensions can be subjected to even greater loading. The flat files tested had frames and shelf casings of light weight metal, but other substantially strong and rigid materials could be utilized for the frame and casings.

INDUSTRIAL APPLICABILITY

The flat files of the present invention can be used in offices, factories, and the like, and preferably can be used to store large paper documents (blueprints, architectural drawings, and the like) in an open or flat position.

While several embodiments described herein are at present considered to be preferred, it is understood that various modifications and improvements may be made therein, and it is intended to cover in the appended claims all such modification and improvements as fall within the true spirit and scope of the invention.

What is desired to be claimed and secured by Letters Patent of the United States is:

1. A storage unit comprising in combination:

a housing including at least a fiberboard top wall, a fiberboard bottom wall and two opposed fiberboard side walls, with each wall having a forward edge cooperating to define an open front end for the housing, said housing being formed of a first and a second fiberboard blank, said first blank being scored and folded at boundaries defining one of said side walls, said top wall, and a first layer of said rear wall, said second blank defining the other of said side walls, said bottom wall, and a second layer of said rear wall, said blanks being joined at corners between said top and bottom walls and said side walls, and said layers of said rear wall being adhered together;

a particle board panel positioned inside of each side wall adjacent the forward edge thereof;

a rearwardly extending groove provided in each of said particle board panels and defining aligned upper and lower internal shoulders;

a fiberboard shelf having a forward edge and including a relatively rigid channelled casing receiving said forward edge;

said shelf and said channelled casing being firmly supported within said grooves between said aligned upper and lower internal shoulders so that said particle boards, shelf and casing define a plurality of accurately spaced and maintained drawer-receiving openings; and a plurality of drawers, at least one of said drawers being slidably supported on said shelf and casing.

2. A storage unit in accordance with claim 1 wherein the forward edge of each of said top, bottom and side walls is provided with a relatively rigid channelled casing and further wherein said wall casings are connected to define a continuous relatively rigid frame which accurately positions and maintains the open front end of said housing.

3. A storage unit in accordance with claim 1 or 2 wherein each particle board includes a plurality of said grooves each defining aligned upper and lower internal shoulders, and wherein said unit includes a plurality of fiberboard shelves each having a relatively rigid channelled casing receiving the forward edge thereof with each shelf and casing firming supported within an aligned pair of said grooves between said upper and lower internal shoulders; and a drawer slidably supported on each of said shelves.

4. A storage unit in accordance with claim 1 or 2 including a fiberboard rear wall and a rearward particle board panel positioned inside of said rear wall; said rearward panel including a groove defining upper and lower internal shoulders and aligned with said grooves in said side particle board panels to receive and support the rear edges of said shelf.

5. A storage unit in accordance with claim 4 wherein said rearward particle board panel is centrally located inside said fiberboard rear wall and has a width of at least about one-third of a width of said rear wall.

6. A storage unit in accordance with claim 1 or 2 wherein said side particle board panels extend rearwardly from the forward edge of said side walls for at least about one-half of the depth of said side walls.

7. A storage unit in accordance with claim 2 wherein said channelled casings defining said rigid frame are generally U-shaped in configuration and are formed from a front member and integral rearwardly extending inner and outer leg members, and further wherein said inner and outer leg members of said side wall casings are continuous to provide said unit with substantial vertical rigidity and strength.

8. The storage unit of claim 2 wherein said channelled frame is formed of an inner leg, outer leg, and interconnecting front member, said outer leg extending rearwardly beyond said inner leg and said frame being bolted to said housing at the sides through said outer leg and respective side wall and particle board panel, and at the top and bottom through said outer leg and respective fiberboard wall.

9. The storage unit of claim 1 wherein said fiberboard top and bottom walls each further include a forward flap extension that is double scored, and a plurality of layers of corrugated fiberboard sheets which are disposed behind said flap extensions, said flap extensions being folded inwardly and rearwardly of the open end of said housing.

* * * * *